US006134850A

United States Patent [19]

Hui et al.

[11] Patent Number: 6,134,850

[45] Date of Patent: Oct. 24, 2000

[54] METHOD AND FIXTURE FOR MOUNTING PROCESS EQUIPMENT

[75] Inventors: Ming-Chu Hui, Hsin-Chu; Bo-Han Hsieh, Chung-Li; Chuan-Yi Wang, Taoyuan; Yien-Yuan Yang, Taipei, all of Taiwan

[73] Assignee: Taiwan Semiconductor Manufacturing Company, Ltd, Hsin Chu, Taiwan

[21] Appl. No.: 09/243,571

[22] Filed: Feb. 3, 1999

[51] Int. Cl.[7] ..... E04B 5/43; E04H 9/02

[52] U.S. Cl. ..... 52/167.1; 52/263; 52/698; 52/745.21; 248/637; 248/499; 248/680

[58] Field of Search ..... 52/263, 167.1, 52/126.5, DIG. 11, 745.21, 750, 698; 248/637, 638, 679, 680, 499, 500, 501

[56] References Cited

U.S. PATENT DOCUMENTS

| | | | |
|---|---|---|---|
| 2,217,788 | 10/1940 | Blake | 248/638 |
| 3,512,738 | 5/1970 | Galbarini et al. | 248/680 |
| 4,321,776 | 3/1982 | Delight | 52/167.1 |
| 5,699,993 | 12/1997 | Hill et al. | 248/680 |
| 5,875,601 | 3/1999 | Gutelius, Jr. et al. | 52/698 |
| 5,946,867 | 9/1999 | Snider, Jr. et al. | 52/167.1 |
| 5,947,430 | 9/1999 | Ryan et al. | 52/126.5 X |
| 5,983,582 | 11/1999 | Vugrek | 52/263 |
| 6,059,251 | 5/2000 | Gutelius, Jr. et al. | 248/499 X |

FOREIGN PATENT DOCUMENTS

| | | | |
|---|---|---|---|
| 55-108535 | 8/1980 | Japan | 52/167.1 |

*Primary Examiner*—Laura Callo
*Attorney, Agent, or Firm*—Tung & Associates

[57] ABSTRACT

A method for earthquake-proof mounting a semiconductor process machine on a removable floor (or a raised floor) in a semiconductor fabrication plant. In the method, a modified I-beam which has a horizontally extending upper flange is provided for mounting under a removable floor and attaching through the floor directly to a process machine situated on top of the floor. The process machine may be attached to the modified I-beam through an L-shaped bracket that is attached to the support frame of the process machine with the horizontal flange of the bracket attached to the modified I-beam through apertures in the removable floor. The present invention further comprises an earthquake-proof mounting fixture for mounting a process machine on a removable floor in a semiconductor fabrication plant. The mounting fixture consists of essentially a modified I-beam for supporting the removable floor on a non-removable floor, the I-beam is equipped with a horizontally extending upper flange for attaching to the process machine directly through the removable floor. The present invention novel method and apparatus allows a process machine to be mounted on a removable floor in a fabrication plant to meet seismic prevention regulations imposed by government agencies for environmental protection and occupational safety. The present invention novel apparatus is especially suitable for use in mounting process machines that holds hazardous, corrosive chemicals for preventing chemicals from spilling during an earthquake, especially when the process machine is mounted on a higher floor in the plant.

20 Claims, 3 Drawing Sheets

METHOD AND FIXTURE FOR MOUNTING PROCESS EQUIPMENT

FIELD OF THE INVENTION

The present invention generally relates to a method and a fixture for mounting a semiconductor process machine on a raised floor in a fabrication plant and more particularly, relates to a method and a fixture for the earthquake-proof mounting of a semiconductor process machine on a raised floor in a fabrication facility by anchoring the process machine directly to an I-beam positioned under the raised floor.

BACKGROUND OF THE INVENTION

Various techniques of etching resist-imaged photomasks, silicon wafers or other semiconductor materials have been used in semiconductor fabrication processes. A wet etching technique conducted in an immersion tank is a practical high-throughput, flexible fabrication process. By properly selecting etchant chemicals, etch reactions with the target film are thermodynamically favored over reactions with other films. Desirable etch-rate ratios can usually be obtained.

A wet etching method is especially suitable for the blanket etching of polysilicon, oxide, nitride and metal. The method is capable of providing the necessary etch selectivity, a damage-free interface and particle-contamination-free wafers. In more recently developed wet etching technology, automated robotic handling systems and ultra-pure chemicals have been used to further improve particle control and process consistency. A well-controlled wet etching technique is therefore the choice of etching process in VLSI and ULSI fabrication processes.

One of the key criteria in carrying out a wet etching process is that the etch products must be soluble in the etchant solution and therefore, no contaminating particles are generated. In an immersion etching process, the volume of the etching tank should be large enough to create enough pressure on the wafer surface in order to dislodge hydrogen gas bubbles evolved during etching reactions; to ensure an accurate balance of the etchant components; to keep the concentration of the etchant relatively constant; and to reduce the number of times the etchant tank must be changed in a production environment. An etchant bath change creates expensive down time, and furthermore, the handling of highly hazardous corrosive materials should be rinimized from a safety standpoint.

Wet etching is a frequently used technique for stripping photoresist films from silicon wafers where a complete removal of the resist images without adversely affecting the wafer surface is desired. The resist layer or images should be completely removed without leaving any residues, including contaminant particles that may have been present in the resist. The underlying surface of the photoresist layer should not be adversely affected, for instance, undesirable etching of the metal or oxide surface should be avoided. Liquid etchant strippers should produce reasonable bath yield in order to prevent redeposition of dissolved resist on the wafers. The etchant should completely dissolve the photoresist layer in a chemical reaction, and not just lifting or peeling so as to prevent redeposition. It is also desirable that the etching or stripping time should be reasonably short in order to permit a high wafer throughput.

Sulfuric acid ($H_2SO_4$) and mixtures of $H_2SO_4$ with other oxidizing agents such as hydrogen peroxide ($H_2O_2$) are widely used in stripping photoresist or in cleaning a wafer surface after the photoresist has been stripped by other means. For instance, a frequently used mixture is seven parts $H_2SO_4$ to three parts of 30% $H_2O_2$, or a mixture of 88% sulfuric acid and 12% nitric acid. Wafers to be stripped can be immersed in the mixtures at a temperature between about 100° C. and about 150° C. for 5~10 minutes and then subjected to a thorough rinse by deionized water and dried by dry nitrogen. Inorganic chemical resist strippers, such as the sulfuric acid mixtures, are very effective in the residual-free removal of highly postbaked resist. They are more effective than organic strippers and the longer the immersion time, the cleaner and more residue-free wafer surface can be obtained.

A typical wet chemical treatment system 10 is shown in FIG. 1. The system has a wet chemical holding tank 12 comprises an inner tank 14 and an outer tank 16. As shown in FIG. 1, the inner tank 14 is usually positioned inside the outer tank 16 and that the sidewall 18 of the inner tank is lower than the sidewall 20 of the outer tank. This allows an operating mode where the inner tank is usually filled first with an etchant chemical through inlets 24 and 26. Inlet 26 to the inner tank 14 also serves as a drain and is connected to drain control valve 28 such that liquid can be drained through outlet 32. Similarly, outlet 34 is connected to the bottom of the outer tank 16 to drain the liquid etchant contained in the outer tank through a drain control valve 36 and the outlet 32.

The wet chemical treatment system 10 also includes a recirculating means 40 which has an inlet 42 for receiving a fluid from outlet 34 of the outer tank 16 through passageway 46, and an outlet 44 for feeding to filter means 50. A frequently used recirculating means suitable for the wet chemical treatment system is a mechanical pump that is specially outfitted for transporting corrosive fluids. In such a pump, any components that are in contact with the fluid being pumped is constructed of stainless steel, a corrosion-resistant polymeric material such as Teflon, or a metal coated with a corrosive-resistant polymeric material. The passage tubing 46, the drain control valves 28, 36, and the outlets 26, 34 are similarly constructed of corrosion-resistant materials.

The wet chemical treatment system 10 further includes a filter means 50 and a heater means 60. The liquid being pumped by the recirculating means 40 through outlet 44 and passage tubing 52 into inlets 54 and 56 of the filter means 50. The filter means 50 is capable of filtering out particulate contaminants in the wet chemical, especially those of metal particles, such that any contamination of the wafer situated in process tank 14 can be avoided. The filtered wet chemical exits the filter means at outlets 48 and 58 to enter into the heater means 60. In most wet chemical treatment processes, either for cleaning or for etching, the wet chemical can be more efficient in its cleaning or etching function when the temperature of the chemical is raised to above ambient temperature. For instance, for most etching and cleaning processes, a temperature of between about 100° C. and about 150° C. is found to be most suitable. The wet chemical enters the heater through inlet 62 and exits at outlet 66 to return the wet chemical to the inner tank 14 through inlets 24 and 26. The inner tank 14 can be filled with fresh chemicals when needed through a filling means 72 controlled by a fill control valve 74.

In the operation of a wet chemical treatment system such as that shown in FIG. 1, the system is normally mounted on a raised floor (or a removable floor) in a semiconductor fabrication facility. A typical mounting method for a wet chemical treatment system is shown in FIGS. 2A and 2B.

After the treatment system 10 is positioned on a raised floor 30 with a bottom bracket 38 contacting the floor, the treatment system 10 is fastened to the raised floor 30 by a welded angle 64. The welded angle 64, frequently made of a corrosion-resistant metal, such as stainless steel, is attached to the side frame 68 of the treatment system 10 by bolts 70. Collars 76 are used to secure bolts 70 in their mounting position. The welded angle 64 is further attached to the raised floor 30 by bolts 78 through a horizontal flange 80 of the angle. The thickness of the welded angle or of any other anchoring metal plate should be at least 1 cm.

The raised floor is normally fabricated of a grating of aluminum which has a smooth top surface and a corrugated back (not shown). The raised floor 30 may also be fabricated of any other suitable material that has the necessary rigidity and lightweight characteristics for easier removal and installation. The raised floor 30 is positioned on top of an I-beam 82 which is in turn positioned on top of a second I-beam 84. Normally, there is no fastening provided between the raised floor 30 and the top surface 86 of the I-beam 82. The I-beam 82 may be fastened to the second I-beam 84 by any suitable mechanical means such as by bolts, or by welding. The bottom flange 88 of the second I-beam 84 may be fastened to a concrete slab floor 90 by bolts 92.

A side view of the welded angle 64 for the wet chemical treatment system 10 is shown in FIG. 2B. In the mounting method shown in FIGS. 2A and 2B, the wet chemical treatment system 10 is only secured to the raised floor 30 that is essentially supported by I-beams that are mounted to a slab floor. The conventional mounting method therefore does not meet the seismic prevention standard that is normally required in fabrication facilities which may be subjected to earthquake damages. The problem can be more serious when the wet chemical treatment system is mounted on a higher floor in a fabrication facility where the effect of an earthquake is more severe. For instance, one of such seismic prevention regulations requires that all equipment foot/frame anchoring mechanism and accessories must be designed to survive a force of 0.35 g×2.36, i.e., a force magnified for a $4^{th}$ floor installation.

It is therefore an object of the present invention to provide a method for mounting a process machine on a removable floor that does not have the drawbacks or shortcomings of the conventional mounting methods.

It is another object of the present invention to provide a method for mounting a process machine on a removable floor that meets seismic prevention regulation for the containment of corrosive chemicals in a wet chemical treatment system.

It is a further object of the present invention to provide a method for mounting a process machine on a removable floor in a semiconductor fabrication facility such that the process machine can survive earthquakes having a force of 0.35 g×2.36.

It is another further object of the present invention to provide a method for mounting a semiconductor process machine on a removable floor in a fabrication facility by providing an I-beam equipped with an extended upper flange for supporting the removable floor.

It is still another object of the present invention to provide a method for mounting a semiconductor process machine on a removable floor in a fabrication facility by providing an I-beam that is equipped with an extended upper flange for supporting the removable floor and for fastening by mechanical means to the process machine through the removable floor.

It is yet another object of the present invention to provide a method for mounting a semiconductor process machine on a removable floor in a fabrication facility by utilizing a modified I-beam for supporting the removable floor and for mounting directly to the process machine.

It is still another further object of the present invention to provide an earthquake-proof mounting fixture for mounting a process machine on a removable floor by utilizing an I-beam modified with an extended upper flange for supporting the removable floor and for attaching directly to the process machine through the floor.

It is yet another further object of the present invention to provide an earthquake-proof mounting fixture for mounting a process machine on a removable floor by providing an I-beam modified with an extended upper flange for attaching to an L-shaped bracket mounted on the process machine through apertures provided in the removable floor.

SUMMARY OF THE INVENTION

In accordance with the present invention, a method for mounting a semiconductor process machine on a removable floor and an earthquake-proof mounting fixture for such use are disclosed.

In a preferred embodiment, a method for mounting a semiconductor process machine can be carried out by the operating steps of first positioning a process machine which has a support frame on a removable floor, providing an I-beam for supporting the removable floor on a non-removable floor, the I-beam is equipped with a horizontally extending upper flange supported by an angle section fixed to a vertical body portion of the I-beam, attaching a lower flange of the I-beam to the non-removable floor, attaching the support frame of the process machine to a vertical flange of an L-shaped mounting bracket, and attaching a horizontal flange of the L-shaped mounting bracket to the horizontally extending upper flange of the I-beam through apertures provided in the removable floor by mechanical means.

The method for mounting a semiconductor process machine on a removable floor may further include the step of providing an upper I-beam and a lower I-beam fixedly attached together for supporting the removable floor on the non-removable floor and for supporting the process machine by a horizontally extending upper flange on the upper I-beam. The mechanical means for attaching the L-shaped mounting bracket to the horizontally extending upper flange of the I-beam may be threaded bolts. The process machine may be a wet etcher. The mounting may survive a 0.35 g×2.36 force earthquake.

The method for mounting a semiconductor process machine may further include the step of fixedly attaching the upper I-beam and the lower I-beam together by mechanical means, or by threaded bolts. The method may further include the step of fixedly attaching the upper I-beam and the lower I-beam together by welding. The method may further include the step of providing the L-shaped mounting bracket in a stainless steel material, or the step of providing the horizontally extending upper flange and the angle support section in a corrosion-resistant metal.

The present invention is further directed to an earthquake-proof mounting fixture for mounting a process machine on a removable floor which includes a process machine that has a support frame positioned on a removable floor, an I-beam for supporting the removable floor on a non-removable floor, the I-beam is equipped with a horizontally extending upper flange attached to a vertical body portion of the I-beam by an angle section, the I-beam is further equipped with a lower flange for attaching to the non-removable floor, and an L-shaped mounting bracket which has a vertical flange for attaching to the support frame of the process machine and a horizontal flange for attaching to the horizontally extending upper flange of the I-beam through apertures provided in and sandwiching the removable floor.

In the earthquake-proof mounting fixture for mounting a process machine on a removable floor, the process machine may be a wet-bench. The mounting fixture may further include a second I-beam fixedly attached to the lower flange of the I-beam for mounting on the non-removable floor. The second I-beam fixedly attached to the lower flange of the I-beam by mechanical means or by welding. The mounting fixture is capable of surviving a 0.35 g×2.36 force earthquake. The L-shaped mounting bracket may be fabricated of stainless steel. The horizontally extending upper flange and the angle section may be fabricated of a corrosion-resistant metal. The removable floor may be an aluminum grating. The non-removable floor may be a concrete slab.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

Figure 1:
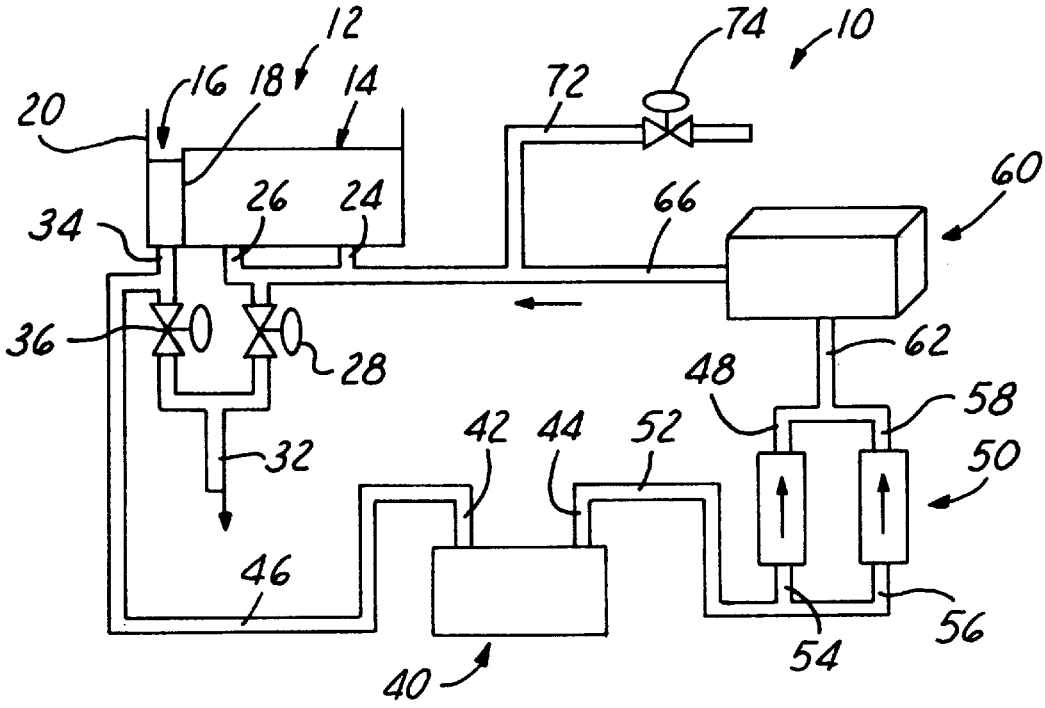
(PRIOR ART) FIG. 1
FIG. 1 is a schematic illustrating a conventional wet chemical treatment system.

The present invention discloses a method for the earthquake-proof mounting of a semiconductor machine on a removable floor in a fabrication facility. While the present invention method is especially suitable for mounting process machines that contain hazardous, corrosive chemicals for preventing spills of the chemicals during an earthquake and thus satisfying seismic prevention regulations, it can be used for mounting any other process machines securely to a removable floor.

In the method, a process machine which has a support frame is first positioned on a removable floor, an I-beam for supporting the removable floor on a non-removable floor is then provided under the removable floor. The removable floor is usually fabricated of an aluminum grating, or an aluminum panel which has a smooth top surface and a corrugated backing. The non-removable floor is normally a slab concrete floor. In the present invention novel method, the I-beam is provided with a horizontally extended upper flange that is fixed to a vertical body portion of the I-beam by an angle section. The horizontally extended upper flange is then fastened to an L-shaped mounting bracket attached to the support frame of the process machine directly by mounting bolts. The lower flange of the I-beam is attached to a concrete slab floor by mechanical means such as bolts.

The present invention novel method provides a more secure mounting method for mounting a process machine that may contain hazardous, corrosive chemicals for surviving an earthquake without spilling the chemicals. Instead of the conventional method wherein a process machine is only fastened to the removable floor and the removable floor is only supported by an I-beam, the present invention provides a more secure method by fastening the process machine directly to the I-beam.

The present invention further discloses an earthquake-proof mounting fixture for mounting a process machine on a removable floor in a semiconductor fabrication plant. The mounting fixture consists of essentially an I-beam for supporting a removable floor on a nonremovable floor. The I-beam is equipped with a horizontally extending upper flange that is attached to a vertical body portion of the I-beam by an angle section. The I-beam is further equipped with a lower flange for attaching to the non-removable floor. The mounting fixture further includes an L-shaped mounting bracket which has a vertical flange attached to the support frame of the process machine and a horizontal flange attached to the horizontally extending upper flange of the I-beam through apertures provided in the removable floor and sandwiching the floor thereinbetween. The present invention mounting fixture is capable of mounting a process machine for surviving a 0.35 g×2.36 force earthquake which is equivalent to the force encountered on a $4^{th}$ floor of a fab plant with the earthquake force amplified by a factor of 2.36. The present invention mounting fixture therefore satisfies the seismic prevention regulations proposed by governmental agencies for environmental protection and for occupational safety.

Figure 2B:
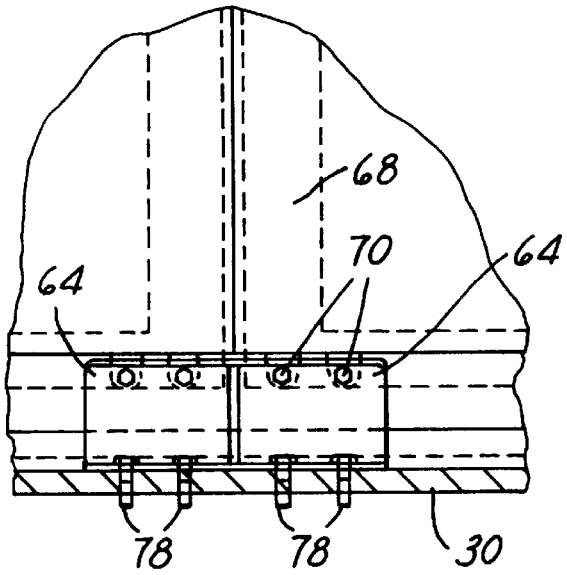
(PRIOR ART) FIG. 2B
FIG. 2B is a side view of the welded angle used to mount the process machine to the removable floor.
Figure 2A:
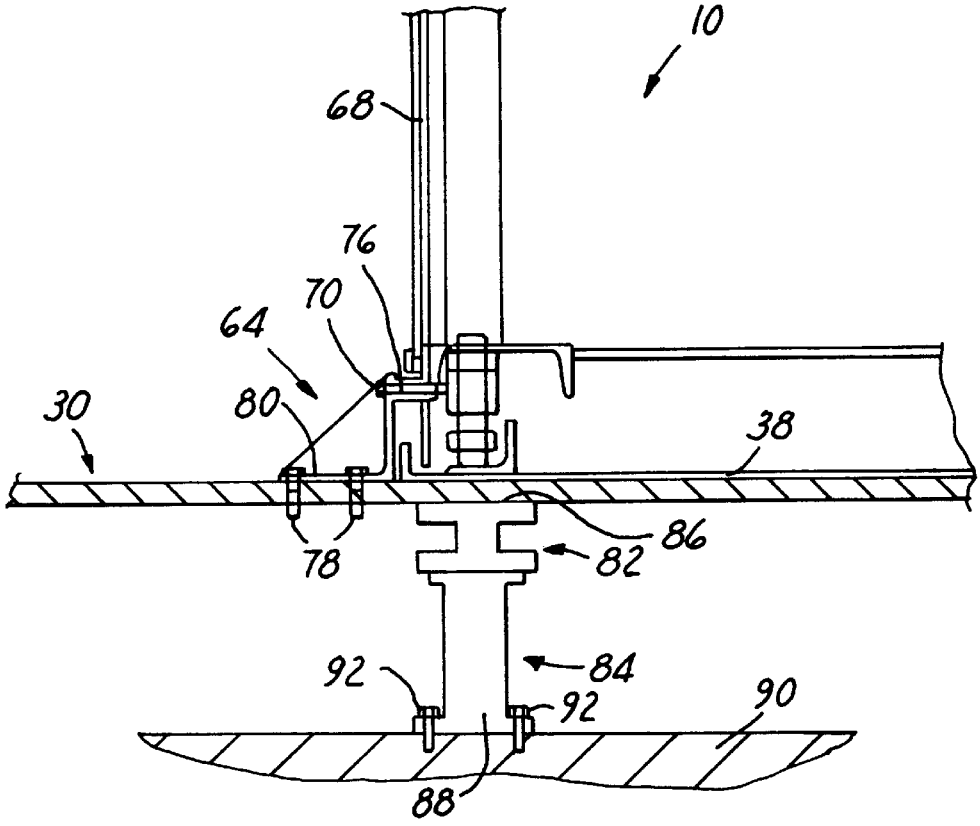
(PRIOR ART) FIG. 2A
FIG. 2A is a cross-sectional view of a conventional mounting method for a wet chemical treatment process machine on a removable and non-removable floor.
Figure 3B:
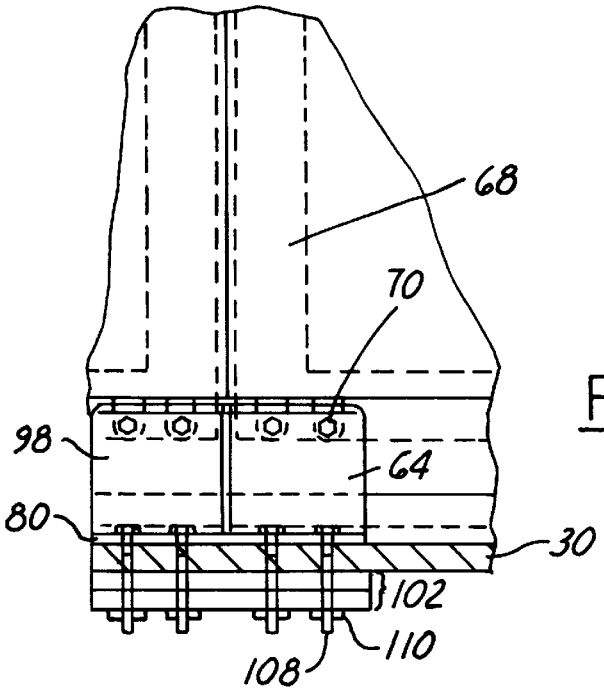
FIG. 3B is a side view of the welded angle fastened directly through the removable floor to a modified upper flange of the I-beam.
Figure 3A:
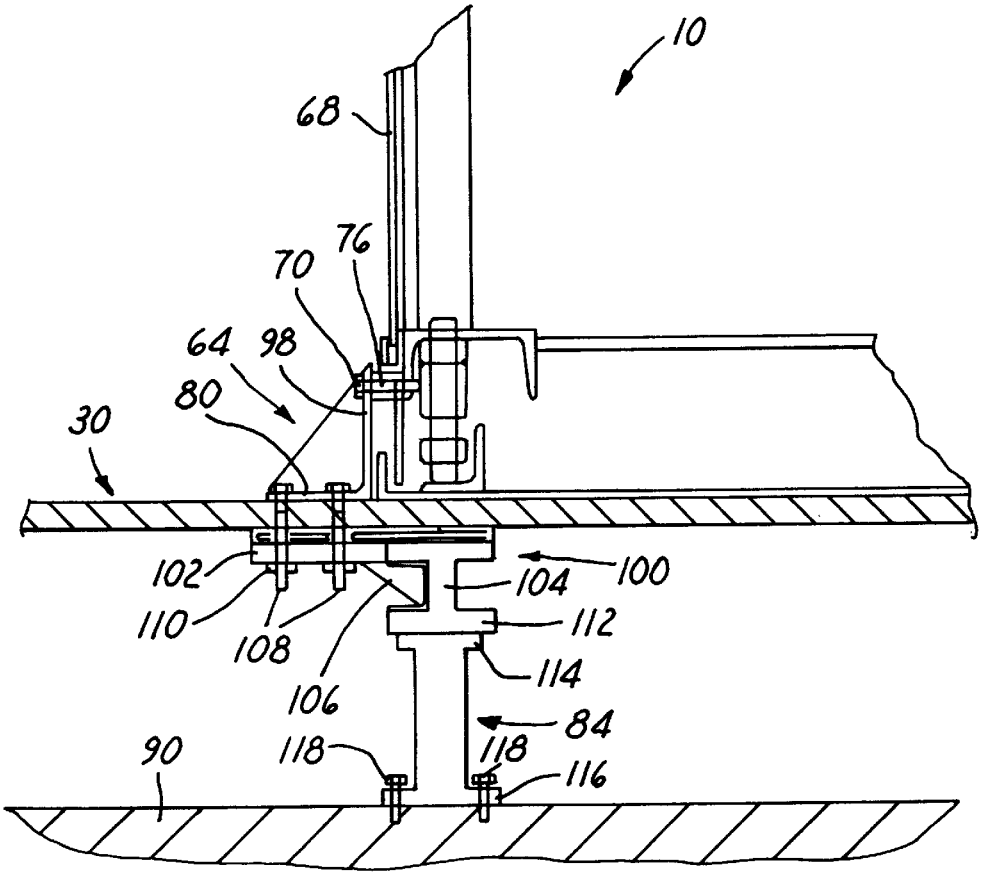
FIG. 3A is a cross-sectional view of a present invention mounting fixture for mounting a wet chemical treatment process machine on a removable floor by using a modified I-beam having a horizontally extending upper flange for fastening directly to an L-shaped bracket connected to the process machine side frame.

Referring now to FIG. 3A, wherein a present invention novel mounting fixture 100 is shown. The mounting fixture 100 is a modified version of the I-beam 82 that was shown in FIG. 2A. In the modified I-beam 100, a horizontally extending upper flange 102 is attached to a vertical body portion 104 of the I-beam 100 by an angle section 106. The horizontally extending upper flange 102 is then attached directly to a horizontal flange 80 of the L-shaped mounting bracket 64 which is attached to a side frame 68 of the wet chemical treatment system 10 through a vertical flange 98 by bolts 70. Collars 76 similar to that used in the conventional attachment is also used. The L-shaped mounting bracket 64 has a horizontal flange 80 which is attached by bolts 108 and nuts 110 directly to the horizontally extending upper flange 102 of the modified I-beam 100. These attachments are also shown in a side view in FIG. 3B.

The present invention novel method and apparatus for mounting a process machine and the advantages made possible are evident from FIGS. 3A and 3B. The novel mounting fixture 100, i.e., the modified I-beam is attached directly to an L-shaped mounting bracket that is attached to the process machine by mounting bolts 108 through apertures provided in the removable floor 30. During an earthquake or any other earth-moving occasions, the process machine 10 is solidly connected to the modified I-beam 100. This is compared to the conventional method wherein the process machine 10 is only connected to the removable raised floor 30 and therefore the machine slides with the removable floor 30 away from the I-beam support. A significantly safer mounting method is therefore provided by the present invention novel mounting fixture for preventing the process machine from spilling hazardous corrosive chemicals during an earthquake occurrence.

The modified I-beam 100 may also be attached to a second I-beam 84 at a lower flange 112 to an upper flange 114 of the second I-beam 84. The attachment method may be mechanical means such as by threaded bolts. The lower flange 116 of the second I-beam 84 may then be attached to the non-removable floor 90 by mechanical means, such as by bolts 118. The non-removable floor 90 may be a concrete slab floor as normally found in semiconductor fabrication plants. The modified I-beam 100 may further be attached to the second I-beam 84 by other means such as by welding.

By using the present invention novel apparatus and method, the process machine mounted can survive a 0.35 g×2.36 earthquake force which is equivalent to an earthquake force experienced on a $4^{th}$ floor of a fabrication plant. The anchoring metal plate, or the L-shaped mounting bracket 64 should be provided in a thickness of not less than 1 cm. The present invention novel apparatus of a mounting fixture therefore satisfies the seismic prevention regulations imposed by the government agencies.

The present invention novel method and apparatus have therefore been amply described in the above descriptions and in the appended drawings of FIGS. 3A and 3B. While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows:

1. A method for mounting a semiconductor process machine comprising the steps of:

positioning a process machine having a support frame on a removable floor, providing an I-beam for supporting said removable floor on a non-removable floor, said I-beam being equipped with a horizontally extending upper flange supported by an angle section fixed to a vertical body portion of said I-beam, attaching a lower flange of said I-beam to said non-removable floor, attaching said support frame of the process machine to a vertical flange of an L-shaped mounting bracket, attaching a horizontal flange of said L-shaped mounting bracket to said horizontally extending upper flange of said I-beam through apertures provided in said removable floor by mechanical means.

2. A method for mounting a process machine according to claim 1 further comprising the step of providing an upper I-beam and a lower I-beam fixedly attached together for supporting said removable floor on said non-removable floor and for supporting said process machine by a horizontally extending upper flange on said upper I-beam.

3. A method for mounting a process machine according to claim 2 further comprising the step of fixedly attaching said upper I-beam and said lower I-beam together by mechanical means.

4. A method for mounting a process machine according to claim 2 further comprising the step of fixedly attaching said upper I-beam and said lower I-beam together by bolts.

5. A method for mounting a process machine according to claim 2 further comprising the step of fixedly attaching said upper I-beam and said lower I-beam together by welding.

6. A method for mounting a process machine according to claim 1, wherein said mechanical means for attaching said L-shaped mounting bracket to said horizontally extended upper flange of said I-beam is threaded bolts.

7. A method for mounting a process machine according to claim 1, wherein said process machine is a wet etcher.

8. A method for mounting a process machine according to claim 1, wherein said mounting method survives a 0.35 g×2.36 force earthquake.

9. A method for mounting a process machine according to claim 1 further comprising the step of providing said L-shaped mounting bracket in stainless steel.

10. A method for mounting a process machine according to claim 1 further comprising the step of providing said horizontally extending upper flange and said support angle section in a corrosion-resistant metal.

11. An earthquake-proof mounting fixture for mounting a process machine on a removable floor comprising:

a process machine having a support frame positioned on a removable floor, an I-beam for supporting said removable floor on a non-removable floor, said I-beam being equipped with a horizontally extending upper flange attached to a vertical body portion of said I-beam by an angle section, said I-beam being further equipped with a lower flange for attaching to said non-removable floor, and an L-shaped mounting bracket having a vertical portion for attaching to said support frame of said process machine and a horizontal portion for attaching to said horizontally extending upper flange of said I-beam through apertures provided in and sandwiching said removable floor.

12. An earthquake-proof mounting fixture for mounting a process machine on a removable floor according to claim 11, wherein said process machine is a wet-bench.

13. An earthquake-proof mounting fixture for mounting a process machine on a removable floor according to claim 11 further comprising a second I-beam fixedly attached to said lower flange of said I-beam for mounting on said non-removable floor.

14. An earthquake-proof mounting fixture for mounting a process machine on a removable floor according to claim 13, wherein said second I-beam fixedly attached to said lower flange of said I-beam by mechanical means.

15. An earthquake-proof mounting fixture for mounting a process machine on a removable floor according to claim 13, wherein said second I-beam fixedly attached to said lower flange of said I-beam by welding.

16. An earthquake-proof mounting fixture for mounting a process machine on a removable floor according to claim 11, wherein said mounting fixture survives a 0.35 g×2.36 force earthquake.

17. An earthquake-proof mounting fixture for mounting a process machine on a removable floor according to claim 11, wherein said L-shaped mounting bracket is fabricated by stainless steel.

18. An earthquake-proof mounting fixture for mounting a process machine on a removable floor according to claim 11, wherein said horizontally extending upper flange and said angle section are fabricated of a corrosion-resistant metal.

19. An earthquake-proof mounting fixture for mounting a process machine on a removable floor according to claim 11, wherein said removable floor comprises an aluminum grating.

20. An earthquake-proof mounting fixture for mounting a process machine on a removable floor according to claim 11, wherein said non-removable floor comprises a concrete slab.

* * * * *